US007067048B2

(12) United States Patent
Berman et al.

(10) Patent No.: US 7,067,048 B2
(45) Date of Patent: Jun. 27, 2006

(54) METHOD TO IMPROVE THE CONTROL OF ELECTRO-POLISHING BY USE OF A PLATING ELECTRODE AN ELECTROLYTE BATH

(75) Inventors: Michael J. Berman, West Linn, OR (US); Steven E. Reder, Boring, OR (US)

(73) Assignee: LSI Logic Corporation, Milpitas, CA (US)

( * ) Notice: Subject to any disclaimer, the term of this patent is extended or adjusted under 35 U.S.C. 154(b) by 196 days.

(21) Appl. No.: 10/637,385

(22) Filed: Aug. 8, 2003

(65) Prior Publication Data

US 2005/0029122 A1 Feb. 10, 2005

(51) Int. Cl.
*H05K 3/07* (2006.01)

(52) U.S. Cl. ..... 205/645; 205/672; 205/673; 204/229.9; 204/234; 204/275.1

(58) Field of Classification Search ..... 204/234; 205/673
See application file for complete search history.

(56) References Cited

U.S. PATENT DOCUMENTS

| | | | | |
|---|---|---|---|---|
| 5,507,923 | A * | 4/1996 | Stouse et al. | 205/679 |
| 6,458,262 | B1 * | 10/2002 | Reid | 205/82 |
| 6,899,804 | B1 * | 5/2005 | Duboust et al. | 205/650 |
| 2002/0153246 | A1 * | 10/2002 | Wang | 204/297.01 |
| 2003/0070918 | A1 * | 4/2003 | Hanson | 204/275.1 |

* cited by examiner

*Primary Examiner*—Roy King
*Assistant Examiner*—Michael P. Alexander
(74) *Attorney, Agent, or Firm*—Trexler, Bushnell, Giangiorgi, Blackstone & Marr, Ltd.

(57) ABSTRACT

A method and apparatus which uses a plating electrode in an electrolyte bath. The plating electrode works to purify an electrolyte polishing solution during the electro-polishing process. Preferably, the plating electrode is employed in a closed loop feedback system. The plating electrode may be powered by a power supply which is controlled by a controller. A sensor may be connected to the controller and the sensor may be configured to sense a characteristic (for example, but not limited to: resistance, conductance or optical transmission, absorption of light, etc.) of the electrolyte bath, which tends to indicate the level of saturation. Preferably, the plating electrode is easily replaceable.

5 Claims, 2 Drawing Sheets

METHOD TO IMPROVE THE CONTROL OF ELECTRO-POLISHING BY USE OF A PLATING ELECTRODE AN ELECTROLYTE BATH

BACKGROUND

The present invention generally relates to methods and apparatuses for electro-polishing a semiconductor wafer, and more specifically relates to a method and apparatus which uses a plating electrode in an electrolyte bath to improve control in a semiconductor electro-polishing process.

Current semiconductor electro-polishing methods generally require an electrolyte polishing solution to be circulated from a reservoir tank to a processing chamber and back to the reservoir tank. During the electro-polishing process, the material that is being polished (i.e., copper) is dissolved from the semiconductor wafer, into the electrolyte polishing solution, and is drained back into the reservoir. With time, the electrolyte polishing solution becomes saturated with the dissolved material (i.e., saturated with copper) and discolored. This build-up of dissolved material can affect many of the process parameters that are needed to maintain a stable, controllable process. Several of these parameters include optical endpoint detection, conductivity of the electrolyte, and possibly others.

One existing solution to the problem of over-saturation of the electrolyte polishing solution is to change the electrolyte polishing solution (i.e., dump all of the old electrolyte polishing solution and use all-new electrolyte polishing solution). However, this solution is often very expensive due to the fact that many electrolyte polishing solutions are proprietary blends and unique to the tool vendor. Furthermore, flushing the electrolyte polishing solution increases the liquid waste stream, and treating the waste can be expensive due to the waste including heavy metals. Still further, flushing the electrolyte polishing solution results in tool downtime. Finally, as the concentration of the material to be polished (i.e., copper) increases in the electrolyte polishing solution, the process conditions change.

OBJECTS AND SUMMARY

An object of an embodiment of the present invention is to provide a method and apparatus which maintains a constant electrolytic quality for process controllability during a semiconductor wafer electro-polishing process.

Another object of an embodiment of the present invention is to provide a method and apparatus which obviates the need to constantly flush and change an electrolyte polishing solution in a semiconductor wafer electro-polishing process.

Still another object of an embodiment of the present invention is to provide a method and apparatus which allows for improved process control and repeatability over time in a semiconductor wafer electro-polishing process.

Briefly, and in accordance with at least one of the foregoing objects, an embodiment of the present invention provides a method and apparatus which uses a plating electrode in an electrolyte bath. The plating electrode works to purify an electrolyte polishing solution during the electro-polishing process. Preferably, the plating electrode is employed in a closed loop feedback system. The plating electrode may be powered by a power supply which is controlled by a controller. A sensor may be connected to the controller and the sensor may be configured to sense a characteristic (for example, but not limited to: resistance, conductive or optical transmission, absorption of light, etc.) of the electrolyte bath, which tends to indicate the level of saturation. Preferably, the plating electrode is easily replaceable.

BRIEF DESCRIPTION OF THE DRAWINGS

The organization and manner of the structure and operation of the invention, together with further objects and advantages thereof, may best be understood by reference to the following description, taken in connection with the accompanying drawing, wherein.

DESCRIPTION

Figure 1:
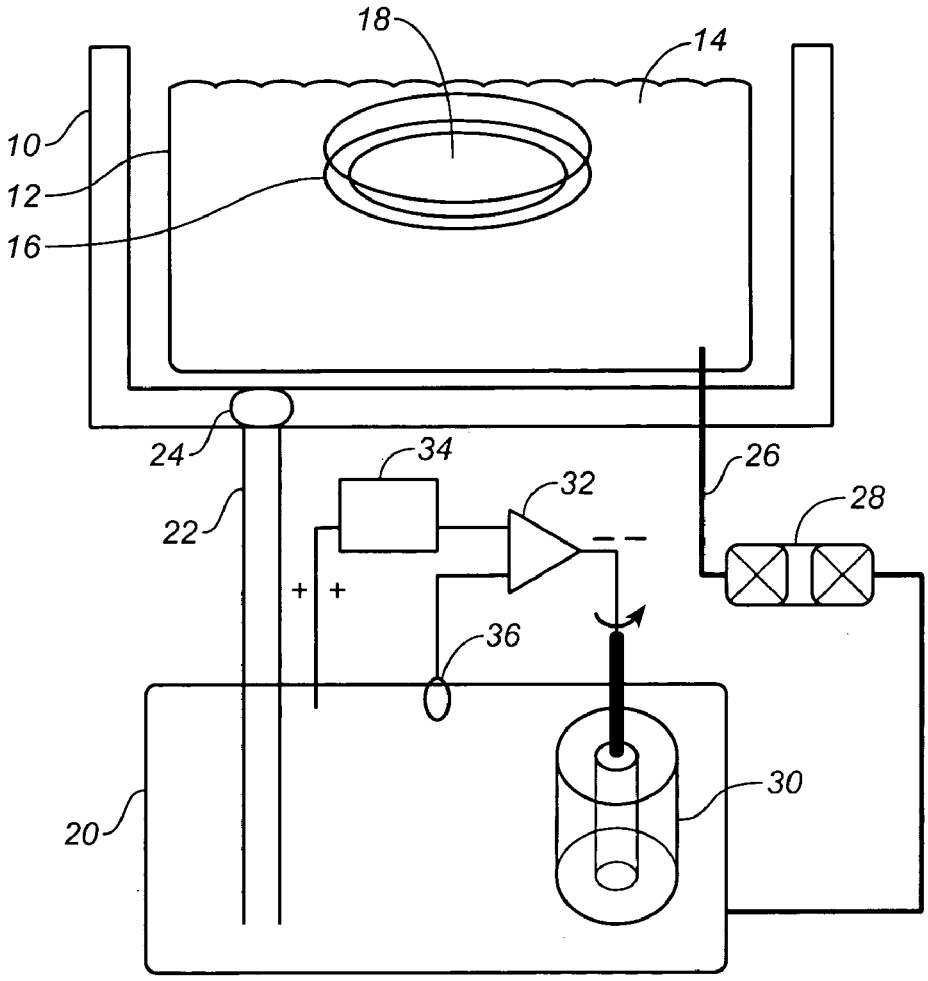
FIG. 1 illustrates a semiconductor wafer electro-polishing system which is in accordance with an embodiment of the present invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
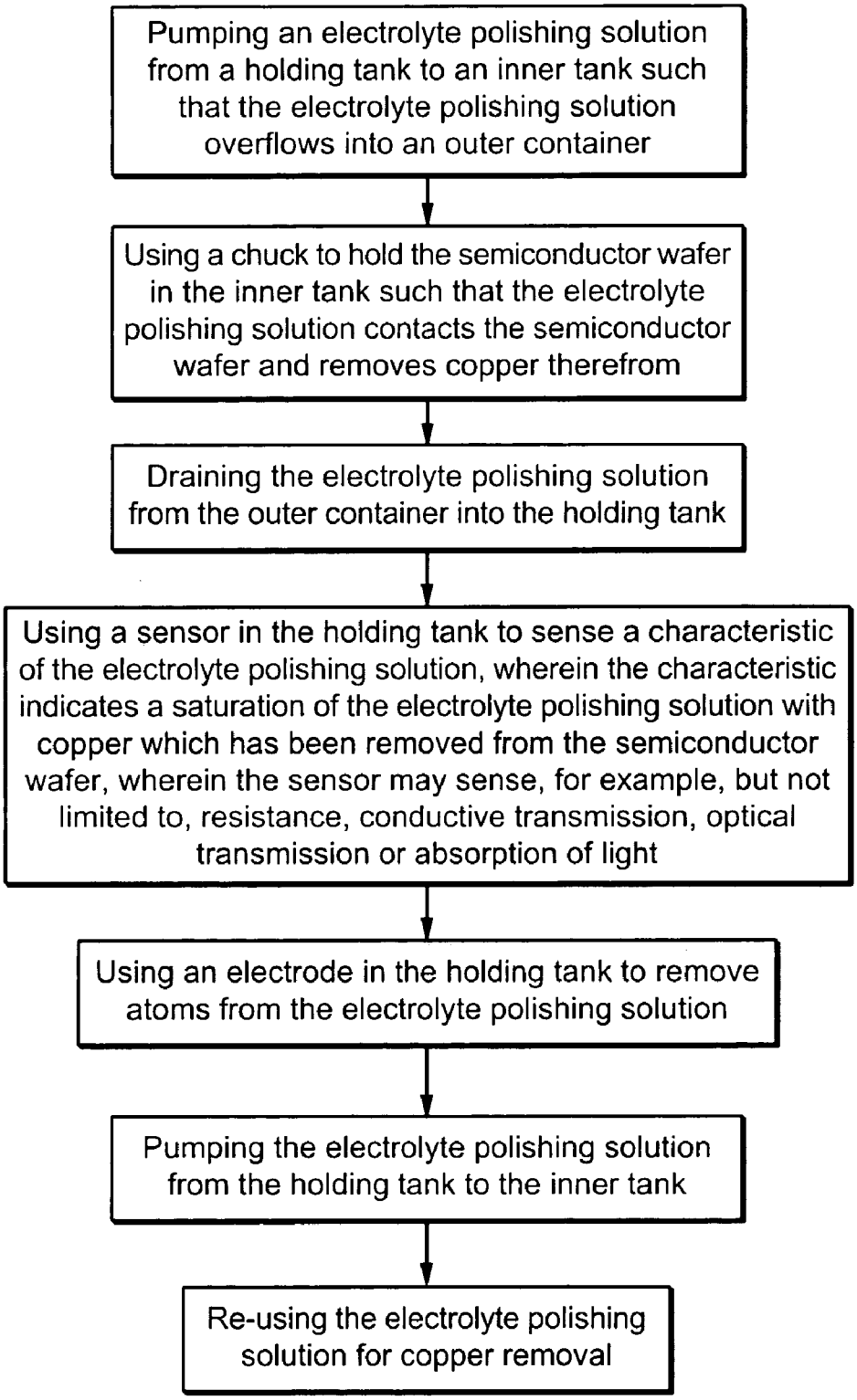
FIG. 2 provides a block diagram of a semiconductor wafer electro-polishing process which is in accordance with an embodiment of the present invention.

FIG. 1 illustrates a semiconductor wafer electro-polishing system, and FIG. 2 illustrates a semiconductor wafer electro-polishing process, both of which are in accordance with embodiments of the present invention. The system and method maintain a constant electrolytic quality for process controllability, obviate the need to constantly flush and change an electrolyte polishing solution, and allow for improved process control and repeatability over time.

FIG. 1 illustrates those components of the system which are relevant to the present invention. One having ordinary skill in the art would understand that the system includes additional components which are not specifically shown, and that those components which are shown, are shown only in a representative capacity only, and are certainly not shown to scale.

As shown in FIG. 1, the system includes an outer container 10 of an overflow weir, an inner tank 12 which holds an electrolyte polishing solution 14, and a chuck 16 to hold the semiconductor wafer 18 which is to be polished. Although not specifically shown, the system includes an external automation system for loading the wafer onto the chuck, and an external automation system for immersing the wafer into the inner tank 12. A main holding tank 20 is provided, and a drain pipe 22 is provided between a drain 24 in the outer container 10 and the main holding tank 20. A line 26 is provided for carrying the electrolyte polishing solution back to the inner tank 12 (i.e., the processing weir). A pump 28 is provided in the line to pump the electrolyte polishing solution through the line 26. An electroplating electrode 30 (i.e., cathode) is disposed in the main holding tank 20 for removing excess copper atoms (if copper is the material which is polished off the semiconductor wafer) from the main holding tank 20. As such, the system can be described as being a copper gettering system, wherein the term getter is being used to describe the action of plating out the dissolved excess copper atoms on an electrode. Preferably, the electrode 30 is provided as being replaceable.

Preferably, the electrode 30 is provided in a closed loop feedback system, wherein a controller 32 controls a power supply 34 which powers the electrode 30 (i.e., regulates the current), and a sensor 36 is connected to the controller 32 such that the electrode 30 is operated based on what is sensed by the sensor 36. Preferably, the sensor 36 is disposed in the main holding tank 20 and senses a characteristic (for example, but not limited to: resistance, conductive or optical transmission, absorption of light, etc.) of the electrolyte bath, which tends to indicate the level of saturation (i.e., the amount of copper in the electrolyte polishing solution). Alternatively, the electrode 30 can be implemented in a time-controlled, non-closed feedback loop system.

FIG. 2 illustrates a method of using the system shown in FIG. 1, and is self-explanatory. The electrode maintains the electrolyte polishing solution in a stable condition. By removing the dissolved material (i.e., copper), the electrolyte polishing solution remains close to its original quality. This allows for improved process control and repeatability over time during the electro-polishing process.

While an embodiment of the present invention is shown and described, it is envisioned that those skilled in the art may devise various modifications of the present invention without departing from the spirit and scope of the appended claims.

What is claimed is:

1. A method of electro-polishing a semiconductor wafer having copper thereon, said method comprising: providing an outer container having a drain, a drain pipe connected to the drain of the outer container, an inner tank disposed in the outer container, and a holding tank below the outer container, wherein the outer container gravity feeds into the holding tank through the drain and drain pipe, providing a pump between the holding tank and the inner tank, using the pump to pump an electrolyte polishing solution from the holding tank to the inner tank such that electrolyte polishing solution spills into the outer container, holding the semiconductor wafer in the inner tank such that the electrolyte polishing solution contacts the semiconductor wafer and removes copper from the semiconductor wafer; draining, via gravity feed, the electrolyte polishing solution through the drain of the outer container through the drain pipe and into said holding tank; using an electrode in the holding tank to remove copper atoms from the electrolyte polishing solution; and after using the electrode to remove copper atoms from the electrolyte polishing solution, using the pump which is provided between the holding tank and the inner tank to re-pump the electrolyte polishing solution directly into the inner tank for re-use.

2. A method as recited in claim 1, further comprising using a sensor to sense a characteristic of said electrolyte polishing solution.

3. A method as recited in claim 1, further comprising using a sensor in said holding tank to sense a characteristic of said electrolyte polishing solution.

4. A method as recited in claim 2, wherein the characteristic indicates a saturation of said electrolyte polishing solution with said copper removed from the semiconductor wafer.

5. A method as recited in claim 2, wherein the step of using a sensor to sense a characteristic of said electrolyte polishing solution comprises sensing at least one of resistance, conductive transmission, optical transmission and absorption of light.

* * * * *